United States Patent [19]

Takenouchi et al.

[11] 4,395,280

[45] Jul. 26, 1983

[54] PREHEATING PROCESS FOR STEEL-MAKING MATERIALS

[75] Inventors: Akira Takenouchi, Aichi; Yukio Niwa, Kounan, both of Japan

[73] Assignee: Daidotokushuko Kabushiki Kaisha, Nagoya, Japan

[21] Appl. No.: 237,768

[22] Filed: Feb. 24, 1981

[30] Foreign Application Priority Data

Feb. 29, 1980 [JP] Japan ..... 55-25836
Aug. 5, 1980 [JP] Japan ..... 55-107979

[51] Int. Cl.[3] ..... C22B 1/00

[52] U.S. Cl. ..... 75/28; 75/44 S; 266/44; 266/157; 432/9

[58] Field of Search ..... 432/9, 156, 14; 75/43, 75/44 R, 44 S, 13, 25; 266/901, 44, 142, 165, 157

[56] References Cited

U.S. PATENT DOCUMENTS 3,399,992 9/1968 Ciochetto ..... 75/43

FOREIGN PATENT DOCUMENTS 850401 11/1972 U.S.S.R. ..... 266/901

*Primary Examiner*—M. J. Andrews
*Attorney, Agent, or Firm*—Armstrong, Nikaido, Marmelstein & Kubovcik

[57] ABSTRACT

A preheating process for steel-making materials, in which the steel-making materials are preheated in a preheating furnace and transferred to a bucket in a clean state for charging them into the steel-making furnace by scattering any dust sticking to the materials by dumping them into the bucket and collecting the scattered dust.

3 Claims, 6 Drawing Figures

PREHEATING PROCESS FOR STEEL-MAKING MATERIALS

BACKGROUND OF THE INVENTION (1) Field of the Invention

The present invention relates to a process and a preheater for preheating scraps and alloy pig iron to be fed to a steel-making furnace such as an arc furance or an induction furnace.

(2) Description of the Prior Art

It is a well-known art to reduce solution heat energy by preheating steel-making materials by waste gas from the steel-making furance. However, there have been several bottlenecks in processes and preheaters so far.

That is, for instance, the waste gas from the steel making furnace is fed to the preheating furnace in which the bucket charging scraps and so on are put. In the case where the bucket is not permeable and the waste gas cannot contact directly with the steel-making material, the heating efficiency is low and the materials cannot be preheated enough as desired. In the case where the bucket is permeable and the waste gas contacts directly with the steel-making materials, a lot of dust composed of oxidized steel, zinc, lead, etc. present in the waste gas sticks and accumulates on the steel-making materials. After the preheating when these materials are charged into the steel-making furance, a lot of said dust soars and stains inside the surrounding equipment of the works thus deteriorating working environment. Moreover, in the case where the bucket is permeable the bucket is seriously damaged by the waste gas carrying the dust passing through the bucket at a high temperature of about 1000° C. As a result in the case of a life of the bucket is short. Especially, the bucket for charging materials to an arc furnace having a movable part, it is un-reasonable to charge such a bucket into the said preheating furnace, because there is a possibility of seizure of the moveable part.

SUMMARY OF THE INVENTION

The present invention relates to a preheating process and a preheater for steel-making materials, in which the steel-making materials are preheated inside a preheating furnace having an openable bottom by directly contacting with the waste gas from the steel-making furnace. The preheated materials are transferred to the bucket positioned directly under the preheating furnace, by opening the bottom of the furnace and dumping the materials therefrom. The soaring dust due to the impact of the dumping is collected by a duct connected to the upper part of the preheating furnace. And, the preheating furnace in the preheater of the present invention is of a fixed or a removable type. A duct connecting to the steel-making furnace is connected to the lower part of the preheating furnace and a grating is circumferentially arranged inside the furnace. The waste gas fed by the duct from the steel-making furnace is designed to flow into steel-making materials charged inside the grating. The upper opening of the preheating furnace is covered with a removable dust collecting hood which is connected to a dust collector. The steel-making materials are charged from the upper opening of the preheating furnace by removing the hood. The bottom of the preheating furnace is formed to be openable so that the preheated steel-making materials can be transferred from the preheating furnace to the bucket positioned directly under the furnace by opening the bottom of the furnace and dumping them therefrom. Soaring dust due to the dumping of the steel-making materials from the preheating furnace is collected to the dust collector through the dust collecting hood covering the upper opening of the preheating furnace. With respect to the removable type preheating furnace, the dust collecting hood is designed to be also removable to cover the upper opening of the furnace after the removal of the furnace.

An object of the present invention is to provide a preheating process and a preheater for steel-making materials so that when charging preheated materials to a steel-making furnace, dust cannot soar inside a works and deteriorate the working environment.

Another object of the present invention is to provide a preheater whose preheating efficiency is high enough as desired to preheat steel-making materials.

Further object of the present invention is to provide a preheater which can relatively be easily repaired even if it is damaged by waste gas of a high temperature.

Still further object of the present invention will be cleared by later description.

DESCRIPTION OF THE PREFERRED EMBODIMENTS

Figure 1:
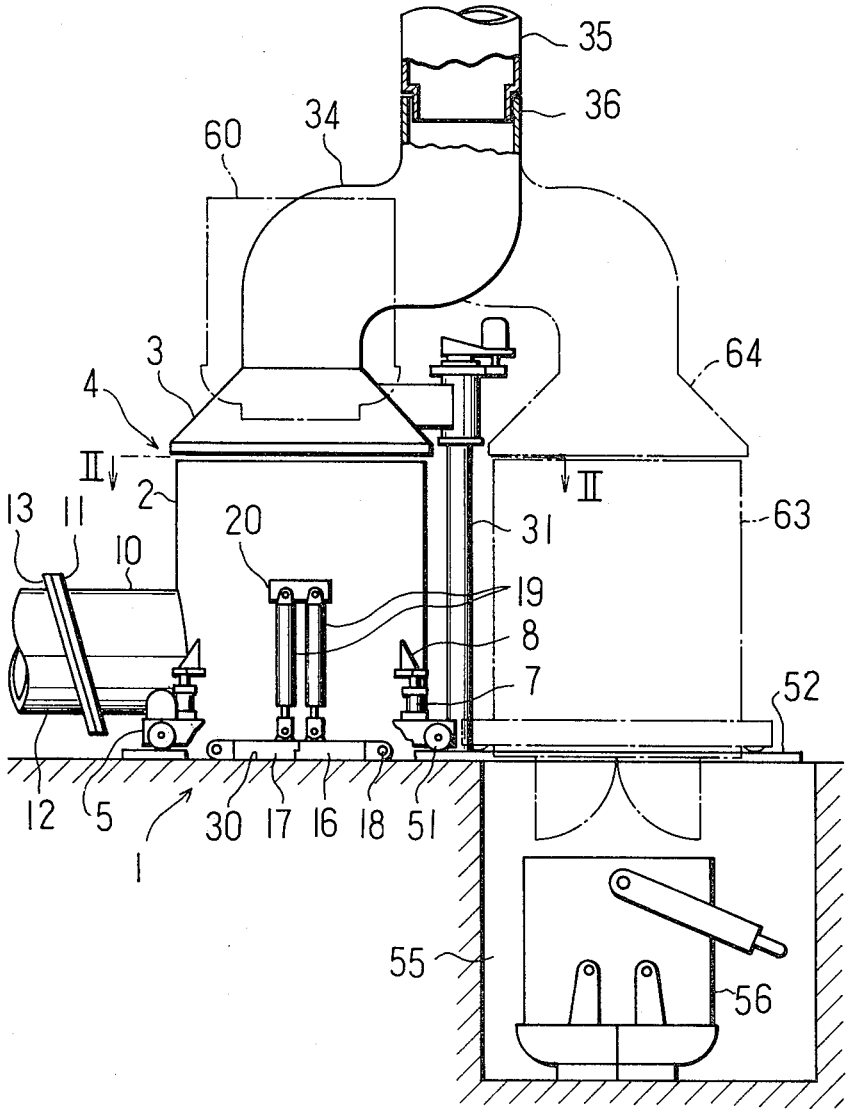
FIG. 1 is a front view showing an embodiment of a preheater for steel-making materials of the present invention.

The invention will now be described in more detail referring to the drawings:

EXAMPLE 1

Figure 2:
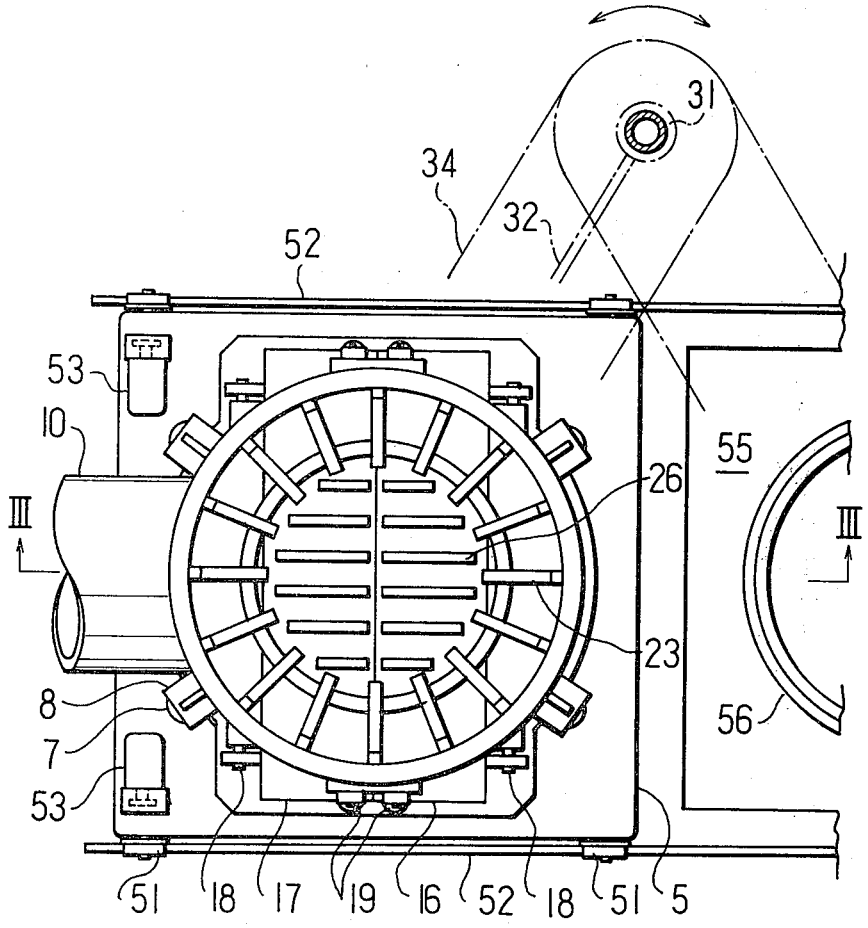
FIG. 2 is a cross sectional top view taken along the line II—II of FIG. 1.
Figure 3:
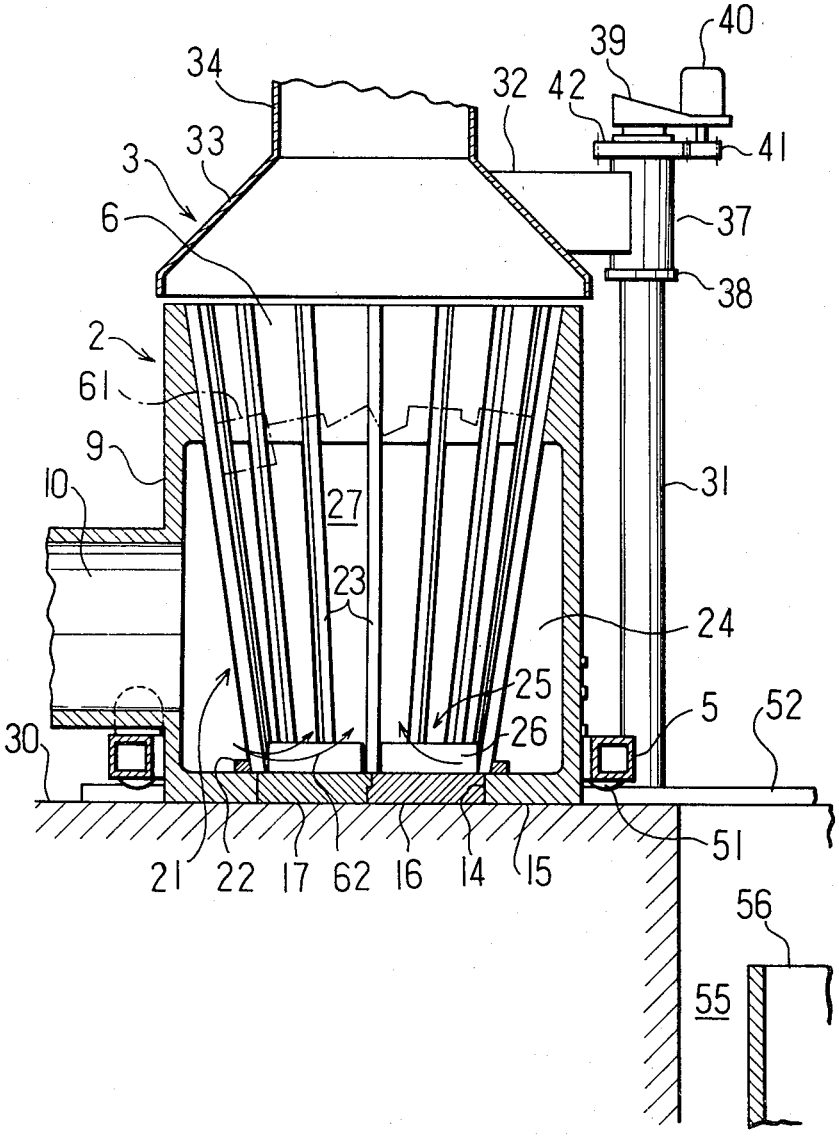
FIG. 3 is a cross sectional front view taken along the line III—III of FIG. 2.

In FIGS. 1 to 3, a preheater 1 for steel-making materials, comprises a furnace body 2 of a cylindrical drum form, a removable dust collecting hood 3, a preheating furnace 4 and push car 5. The furnace body 2 is provided with an upper opening 6 opening upwards and lined with refractories on the furnace shell made of steel plates. The vicinity of the bottom of the furnace body is in the state that the push car is able to pass through, and freely supported to be raised or lowered on the push car 5 by four hydraulic jacks 7. A bracket 8 projects on a side wall 9 of the furnace body to which a plunger of each oil hydraulic jack 7 is connected. A waste gas inlet 10 is arranged on the side wall of the furnace body. A flange 11 arranged on the end of the inlet is jointed to a flange 13 of the end of a fixed duct 12. The fixed duct 12 is connected to the furnace cover of the steel-making arc furnace through the combustion tower (not shown). The bottom opening 14 of a nearly square shape is provided with bottom cover 16, 17 of a double-leafed opening out type opening and shutting the bottom opening. Each leaf 16,17 is turnably attached to a horizontal axis 18 projectingly arranged the furnace bottom 15. Air cylinders 9 are provided for opening and shutting of the bottom cover and are connected to a bracket 20 fixed on the side wall 9. The piston rod of each air cylinder is connected to one of the leaves 16, 17 the bottom cover. An inner wall 21 of a permeable grating type, comprises a support ring 22 and a plurality of rods 23. The upper end of ring 22 is fixed on the peripheral part of the upper opening 6 and the lower end is fixed on the vicinity of the bottom opening 14, respectively. A gas guide passage 24 for high-temperature waste gas is formed between the inner wall 21 and the side wall 9. A bottom wall 25 is fixed on the bottom cover leaves 16 and 17, respectively. A plurality of rods square rods 26 is directly and horizontally fixed on the upper surface of the bottom cover leaves in parallel. The scrap housing 27 is enclosed by the inner wall 21 and the bottom wall 25. The dust collecting hood 3 is turnably supported by a bracket 32 around a column 31 set up on a base 30. The upper end of a crank-form duct 34 fixed on a hood 33 forms a turnable joint 36, being turnably fitted into the lower end of a fixed duct 35 arranged concentrically with the column 31. The fixed duct 35 is connected to a duct collector through a waste gas cooler (not shown). The basal part of the bracket 32 is fixed to a sleeve 37 turnably fitted into the column 31, and the lower end of the sleeve is abutted to a collar 38 for supporting downward load, fixed on the column 31. A motor for turning the dust collecting hood is attached to a bracket 39 fixed on the top end of the column 31, and a small toothed wheel 41 fixed on the end of the motor shaft is in gear with a large toothed wheel 42 fixed on the sleeve 37. On the other hand, the push car 5 is provided with wheels 51, loaded on a rail 52 laid on the base 30 and freely driven going to and from by a driving device 53 comprising a motor for driving an axle, a chain sprocket, etc. A pit 55 is arranged under the preheating furnace 4 transferred to a scrap dumping position (described later), into which a bucket 56 for charging scraps to the arc furnace is previously put at a given position. To preheat scraps by means of the preheater, the preheating furnace 4 and the push car 5 at the preheating position shown by a solid line and the furnace body 2 on the base 30 is loaded by operating the oil hydraulic jacks 7. The furnace bottom 15 and furnace cover leaves 16, 17 are in the closed state coming just in contact with base 30. In this state, the dust collecting hood 3 is turned and removed to the sidewards by driving the motor 40. The top of the furnace body 2 is placed in an open state and scrap 61 is charged into the scrap housing 27 by means of a scrap charging bucket 60 suspended by a crane. At this time, since the bottom cover 16 and 17 is just in contact with the base 30, the bottom cover will not be opened by the impact of scrap dumping and the air cylinder 19 and the bucket 20, etc. will not be over loaded. After charging scraps, the dust collecting hood 3 is positioend in a closed state facing to the upper opening 6 of the furnace body through a small clearance as shown by a solid line. Then, high-temperature waste gas from the arc furnace to the waste gas inlet 10 flows into the scrap housing 27 through the gas guide passage 24 and between the grating of the inner wall 21 and as shown by an arrow 62, through the gas guide passage 24 and between the grating of the bottom wall 25, respectively and heats the scrap 61. Thus, high-temperature gas of about 1,000° C. flows into the scrap housing 27 from surroundings and from the bottom, so that scraps are effectively and evenly heated. The temperature of waste gas dropped by passing through the scrap housing 27 flows out through the dust collecting hood 3 and the fixed duct 35 to the outside.

After finishing one charge operation of the arc furnace, the scrap is kept under a thermal insulating condition inside the furnace body 2 in the state of stopping waste gas flowing from the arc furnace. At scrap charging of the next furnace operation, the bottom cover 16 and 17 are best in the fully closed state by the air cylinder 19. The pressure inside the furnace body 2 is increased a little by feeding pressure oil into the oil jack 7, and the push car 5 is driven by means of the driving gear 53. The pressure is kept in the increasing state and the furnace body 2 is transferred to the scrap dumping position as shown by a chain line 63. Then, the dust collecting hood 3 is transferred to the position facing to the upper opening of the furnace body as shown by a chain line 64 and the bottom leaves cover 16 and 17 are turned downwards by driving the air cylinder 19. The heated scrap dumps from the bottom opening 14 into the scrap charging bucket 56. This time, a lot of dust in the waste gas sticking to scraps is scattered by the impact of dumping the scraps against some protions of the bucket 56 and most of the scattered dust is absorbed by the dust collecting hood 3 and collected to the dust collector through the fixed duct 35. And then, the push car 5, the furnace body 2, the dust collecting hood 3, etc. are returned to the preheating position, the bucket 56 by the crane and the preheating scraps are charged into the arc furnace. Since only small amount of dust sticks to these scraps, scattering of dust is very small when charging scraps to the arc furnace.

In the above-mentioned example, the preheating furnace is designed to be transferred to the scrap dumping position after preheating and the scrap is dumped into the bucket put under the furnace. However, a pit may be provided directly under the preheating furnace fixed at the preheating position and scrap may be dumped into the bucket inserted from the horizontal direction to the pit. And in the above-mentioned example, since the dust scattering when dumping scrap into the bucket 56 is designed to be collected by the dust collecting hood 3 for the preheating furnace, the device has merit in concisenss and usefulness. However, a dust collecting method other than the dust collecting hood 3 may be used. And as a preheating furnace, a construction other than the above-mentioned example may be used if it is of the type that scraps are heated by contacting with high-temperature waste gas from the steel-making furnace.

Next, the other example of the preheating furnace body in the present invention will be described referring to the drawings.

EXAMPLE 2

Figure 4:
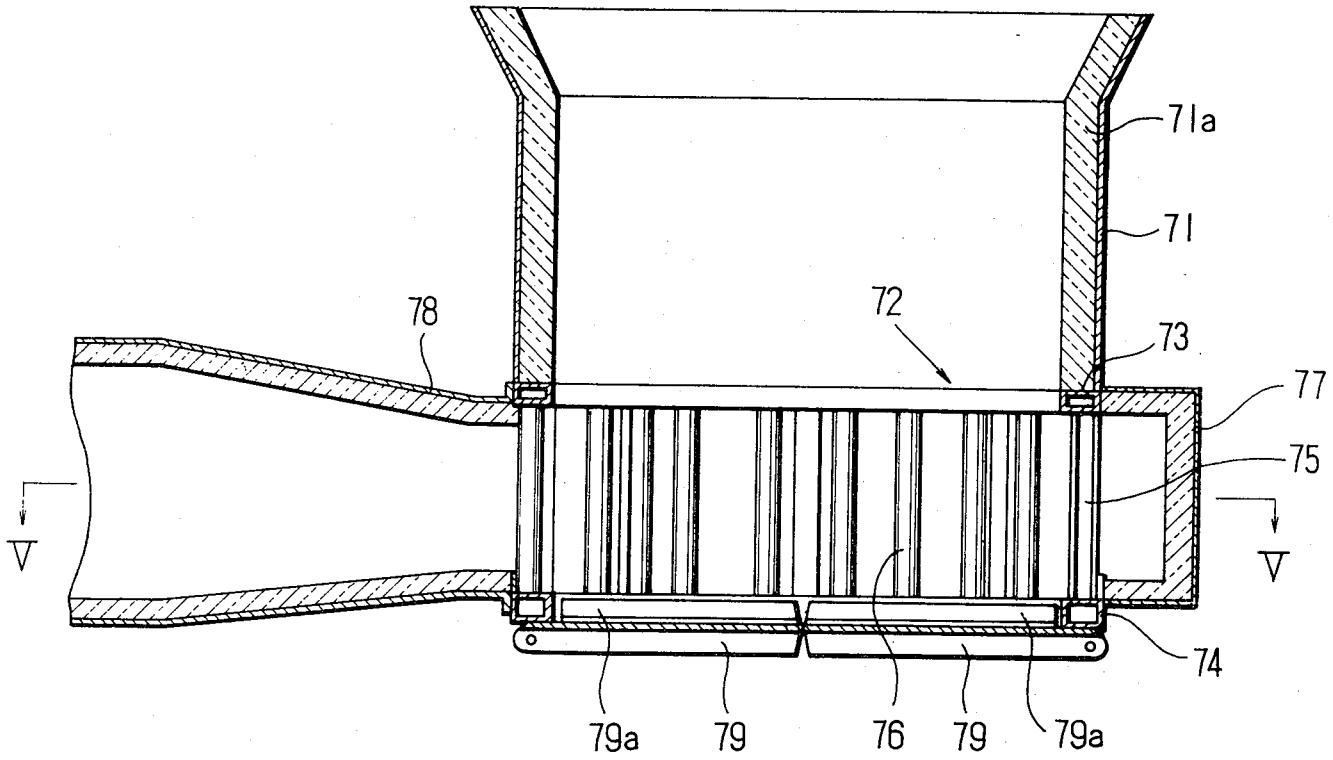
FIG. 4 is a cross sectional front view showing further embodiment of the preheater.
Figure 5:
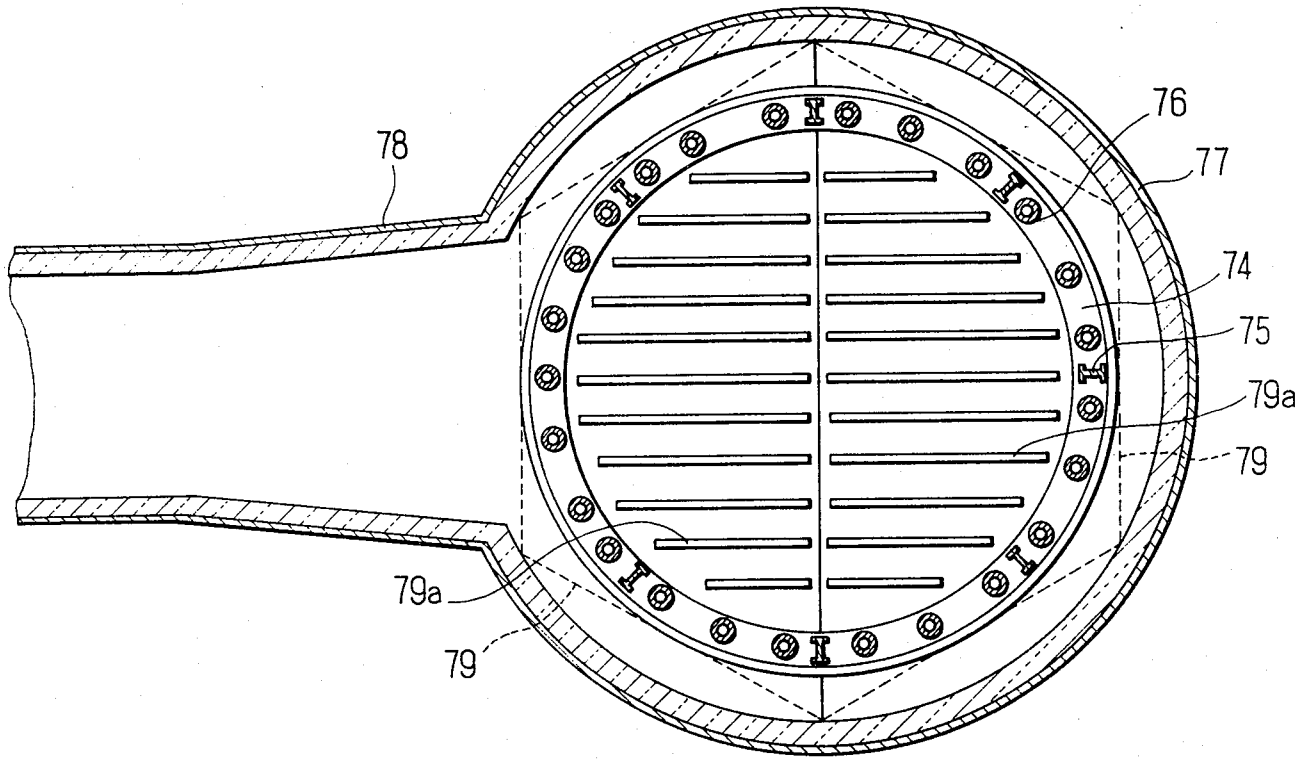
FIG. 5 is a cross sectional top view taken along the line V—V of FIG. 4.

As shown in FIGS. 4 and 5, a furnace wall 71 is formed to be cylindrical and concentrically enlarged at the upper end and lined with an insulating block 71*a* inside. To the lower end of a furnace wall 71, a grated frame 72 is connected. The grated frame 72 comprises an upper ring 73 and a lower ring 74 both of which have cross sections which are hollow squares and both of which are formed to be a circular collar. A plurality of stays 75 and vertically arranged so as to connect the upper and lower ring 73 and 74. The cross section of each stay 75 is of I letter form. A grating 76 is manufactured from tubing. Plural pieces of such gratings are vertically and circumferentially arranged in an equal pitch so as to connect the upper and lower rings 73 and 74.A gas guide passage which cross section of nearly U letter form formed to be annular with an inside diameter set from the opening side. The inside of both upper and lower ends is air-tightly connected to the upper and lower rings 73 and 74, respectively. A duct 78 is connected to in a radius direction against the gas guide passage 77. A bottom cover comprises two leaves 79 which open out downward center from both sides. The two leaves of the bottom cover 79 and 79 are formed to be hexagonal and the basal end forming each side is pivoted to the lower ring 74, and a reinforced plate 79 a is welded on the upper surface.

To the preheating furnace of Example 2, during the charging scraps from the upper part of the furnace wall 71, the admission of scrap into the gas guide passage 77 is checked by the grating 76 and the stay 75. The flowing of the gas inside the gas guide passage 77 is good, so that a part of the high-temperature waste gas fed from the arc furnace to the gas guide passage 77 through the duct 78 passes through the grating 76 facing to the outlet and flows into the gap between the pieces of scrap facing to this part of the grating 76. Another part of the gas flows divergently into the gas guide passage 77 connected to both sides and passes through slits of the grating 76 circumferentially arranged and flows into the gap between pieces of scrap. The above-mentioned, high-temperature waste gas flows into the furnace from all of the circumference of the grating 76 and rises through the gaps between pieces of scrap and flows out outside through the duct 34 connected to a cover (not shown) covering the upper end of the furnace wall 1. Thus, the scrap is healed while the high-temperature waste gas passes through the furnace.

EXAMPLE 3

Figure 6:
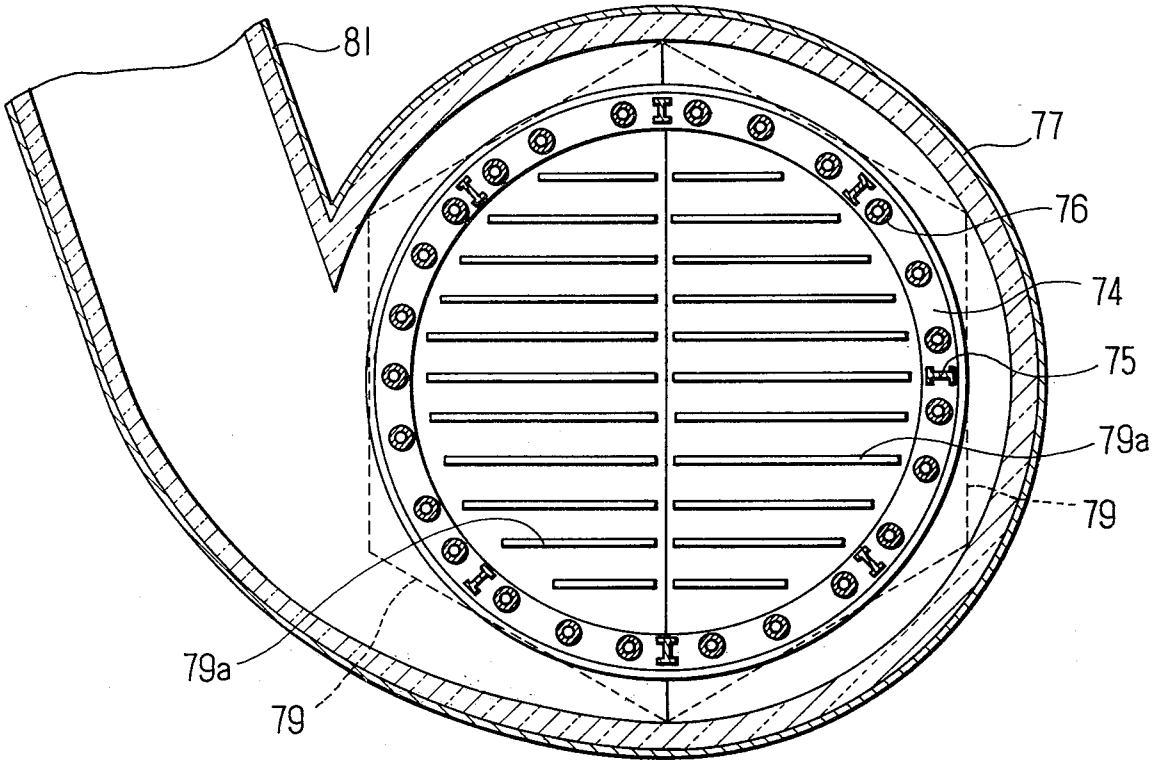
FIG. 6 is a cross sectional top view showing still further embodiment of a preheating furnace in the preheater of the present invention.

The preheating furnace shown in FIG. 6 is formed nearly as good as the Example 2 except that a duct 81 is connected to in a tangential direction against the gas guide passage 77. In this preheating furnace, the high-temperature waste gas from the duct 81 flows in a tangential direction against the gas guide passage 77. The high-temperature gas flows without bumping against the pieces of scrap at a right angle. Therefore, the fluid loss is small and the high-temperature waste gas flows so far as to the small gap between the pieces of scrap and the scrap is more evenly heated.

According to the present invention, as aformentioned, it is designed that the grating 76 is circumferentially arranged on the lower portion of the furnace wall 71; the gas guide passage 77 is circumferentially arranged to the outside of the grating 76; a duct from high-temperature gas source, i.e. the arc furnace, is connected to the gas guide passage 77; the high-temperature gas flows from the duct 78 into the gas guide passage, passes through grating 76 and flows into the furnace from all the circumference of the grating, so that scrap inside the furnace is evenly heated and the thermal efficiency is increased. And, in the preheating furnace that the duct 81 is connected to in a tangential direction against the gas guide passage 77, the fluid loss of the flowing into high-temperature waste gas is small and the high-temperature waste gas flows so far as into the small gap between the pieces of scrap, so that the scrap is more evenly heated and the thermal efficiency is also increased.

What is claimed is:

1. A preheating process for steelmaking materials, which comprises the steps of:

(a) preheating steel making materials by contacting said materials with waste gas fluid containing dust from a steel-making furance in a preheating furnace, some of said dust sticking to said materials.

(b) scattering any dust sticking to the heated steel-making materials by impact of dumping the materials, (c) collecting the scattered dust, and (d) charging the steel-making materials into the steel-making furnace after collecting the dust.

2. A preheating process for steel-making materials as set forth in claim 1, wherein the step of scattering any dust sticking to the heated steel-making materials is done by dumping the materials into a bucket.

3. A preheating process for steel-making materials as set forth in claim 1 or 2, the step of charging steel-making materials into the steel-making furnace after collecting the scattered dust is done by a bucket.

* * * * *